US005333398A

United States Patent [19]

Seo

[11] Patent Number: 5,333,398

[45] Date of Patent: Aug. 2, 1994

[54] LACE FASTENING CLEAT AND SHOE

[76] Inventor: Young S. Seo, 2800 Smith Rd., Fortson, Ga. 31808

[21] Appl. No.: 972,963

[22] Filed: Nov. 6, 1992

Related U.S. Application Data

[63] Continuation-in-part of Ser. No. 780,714, Oct. 21, 1991, abandoned.

[51] Int. Cl.[5] ..... A43B 11/00

[52] U.S. Cl. ..... 36/50.1; 24/712.9

[58] Field of Search ..... 36/54, 50.1; 24/18, 24/127, 712.9

[56] References Cited

U.S. PATENT DOCUMENTS

| | | | |
|---|---|---|---|
| 502,694 | 8/1893 | Smith | 24/712.9 |
| 512,256 | 1/1894 | Matchett | 24/127 X |
| 749,569 | 1/1904 | Luks | 36/54 X |
| 879,272 | 2/1908 | Key | 36/54 X |
| 1,079,882 | 11/1913 | Roberts | 24/712.9 X |
| 1,125,755 | 1/1915 | Sommers et al. | 24/127 |
| 1,329,746 | 2/1920 | Bennor | 24/127 |
| 4,290,173 | 9/1981 | Herlau | 24/127 X |

FOREIGN PATENT DOCUMENTS

| | | | |
|---|---|---|---|
| 0008758 | of 1891 | United Kingdom | 24/712.9 |
| 0010989 | of 1899 | United Kingdom | 24/712.9 |

*Primary Examiner*—Paul T. Sewell
*Assistant Examiner*—Beth Anne Cicconi
*Attorney, Agent, or Firm*—Deveau, Colton & Marquis

[57] ABSTRACT

A shoe with a lace fastening cleat which enables the shoe to be secured without tying a knot and with the use of only one hand or one finger, the shoe comprising a tongue, a lace, and two vamps having lace eyelets for receiving the lace and straddling and partially overlying the tongue. The lace fastening cleat is positioned over the tongue generally between the vamps and includes a lower flange, a shank portion extending from the lower flange, and an upper flange mounted to the shank portion and positioned over the lower flange to define a lace receiving opening between the lower and upper flanges. A lace retaining member is positioned on the lower flange and extends toward the upper flange, and the flanges are flexible relative to each other to allow the flanges to move apart from one another in response to the lace being pulled for winding and unwinding the lace about the shank portion.

11 Claims, 4 Drawing Sheets

LACE FASTENING CLEAT AND SHOE

CROSS-REFERENCE TO RELATED APPLICATIONS

The present application is a continuation-in-part of U.S. application Ser. No. 07/780,714 filed Oct. 21, 1991 now abandoned.

TECHNICAL FIELD

The present invention relates to a shoe having laces and an apparatus constructed to avoid the necessity of tying the laces in a bowknot.

BACKGROUND OF THE INVENTION

A great many shoes are provided with laces for tightening the shoe and for securing the shoe on the foot. This is normally accomplished by drawing the laces taut and then tying the laces in a bowknot . While this is a relatively simple task which is learned by repetition, it can be quite difficult for small children and those who have physical impairments, whether temporary or permanent. A number of arrangements have been devised in the prior art to address this problem. For example, U.S. Pat. No. 3,430,303 of Perrin et al discloses a lace winder in which the laces are wound upon a shaft within a canister and held taut. Also, hook and loop fastening closures have been used to replace laces altogether on some shoes.

U. S. Pat. No. 3,577,606 of Tyrrell discloses a string detention system for retaining shoe laces in a secured and releasable condition. In one embodiment disclosed in the Tyrrell patent, a pair of lashing buttons are fixed to the uppermost eyelets of the shoe, with each lashing button including a base and a flange positioned above the base and a plurality of resilient prongs positioned on the upper surface of the flange. In use, a lace would be wrapped about the button and looped over the prongs to secure the lace between the prongs. In another embodiment, Tyrrell discloses a button mounted above the tongue of the shoe, rather than two (2) buttons mounted on the eyelets. In each case, the buttons undesirably project upwardly and are needed to prevent the laces from becoming unraveled.

Despite these efforts and other known efforts in the art to provide a practical alternative to tying shoe laces in a bowknot, a need yet remains for a shoe having an apparatus for securing the laces of the shoe which can be manipulated by a person with limited manual dexterity or strength. It is to the provision of such a shoe that the present invention is primarily directed.

SUMMARY OF THE INVENTION

Briefly described, in a preferred form, the present invention comprises a shoe including a tongue portion, a lace, and two vamps having lace eyelets for receiving the lace. A fastening cleat is positioned over the tongue generally between the vamps, the fastening cleat comprising a lower flange positioned over the tongue of the shoe and an upper flange mounted over the lower flange to define a lace receiving opening between the lower and upper flanges. A lace retaining member is positioned on one of the lower and upper flanges and extends toward the other flange. The upper flange is flexible relative to the lower flange to allow the flanges to move apart from one another adjacent the lace retaining member in response to the laces being pulled for winding and unwinding the laces about the cleat in the lace receiving opening.

Preferably, the otherwise free ends of the lace are secured to each other to form an endless lace or are secured to the tongue or the vamps.

With this construction, the lace can easily and quickly be tightened and secured by simply pulling on the endless lace, preferably at two points in the middle thereof, and wrapping the endless lace about the cleat. As the lace is pulled and wrapped about the cleat, the lace tends to open up the flanges to allow the lace to slip past the lace retaining member. This arrangement and manner of tightening and retaining the shoe lace requires minimal manual dexterity and is well-suited for those persons having limited use of hands and fingers. This arrangement is particularly helpful for persons having only one functioning hand or finger (or a prosthetic). This arrangement also is quite useful for small children.

In another preferred form, the present invention comprises a fastening cleat for securing laces of a conventional shoe, the fastening cleat being constructed and used generally as described above. The fastening cleat can, in one form, be securely attached to the tongue. In another form, the fastening cleat can be simply secured in position over the tongue by the lace being threaded through the cleat.

Accordingly, it is a primary object of the present invention to provide a lace fastening cleat, alone or in combination with a shoe, which is simple and straightforward to use.

It is another object of the present invention to provide a lace fastening cleat, alone or in combination with a shoe, which is easily used by persons having limited manual dexterity or strength.

It is another object of the present invention to provide a lace fastening cleat, alone or in combination with a shoe, which is easily fastened by young children.

It is another object of the present invention to provide a lace fastening cleat, alone or in combination with a shoe, which is simple in construction, economical in manufacture, and durable in use.

It is another object of the present invention to provide a shoe having a low-profile lace fastening cleat.

It is another object of the present invention to provide a shoe which can be fastened with one hand, one finger, or prosthetic device.

Other objects, features, and advantages of the present invention will become apparent upon reading the following specification in conjunction with the accompanying drawing figures.

BRIEF DESCRIPTION OF THE DRAWING FIGURES

DETAILED DESCRIPTION

Figure 1:
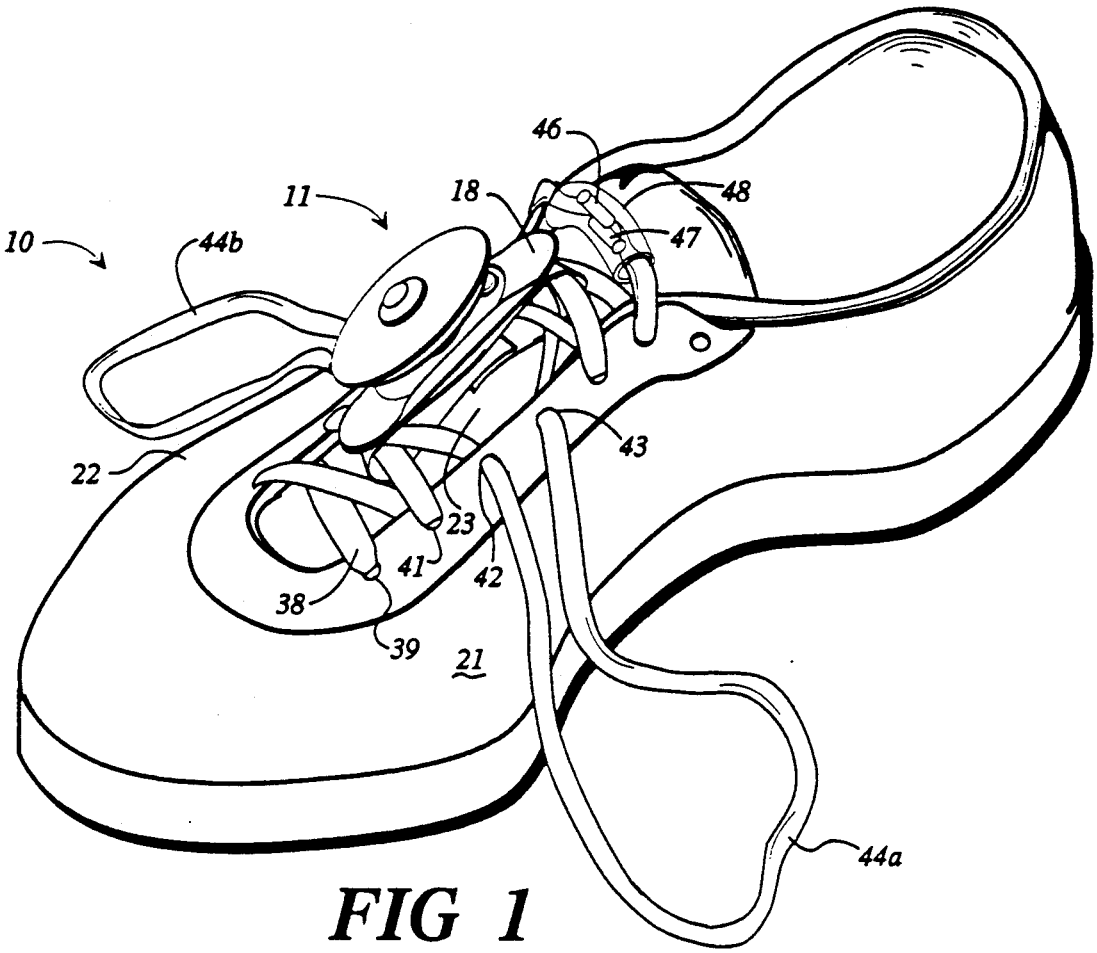
FIG. 1 is a perspective, schematic illustration of a shoe including a fastening cleat according to a preferred form of the invention.
Figure 2:
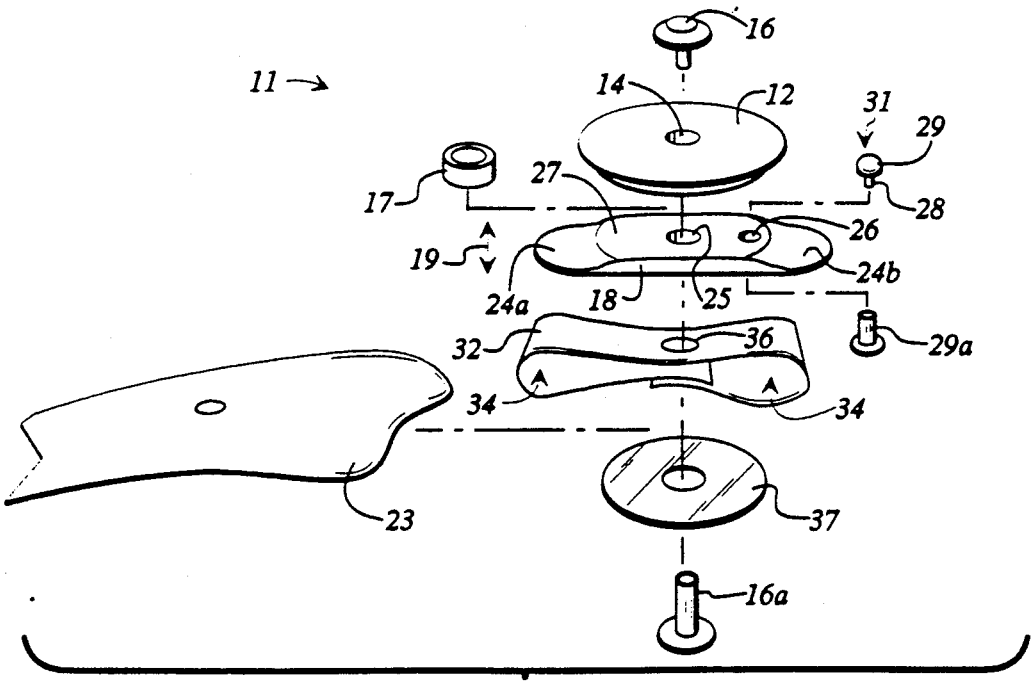
FIG. 2 is an exploded, schematic, perspective view of the fastening cleat portion of the shoe of FIG. 1.
Figure 3:
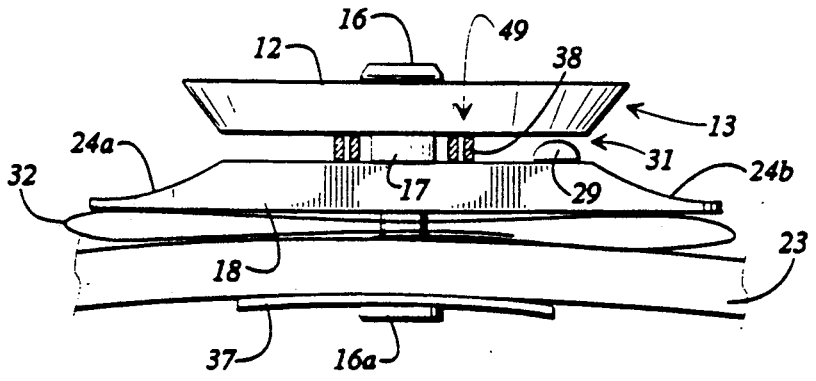
FIG. 3 is a schematic, sectional view of a portion of the fastening cleat portion of FIG. 2.

Referring now in detail to the drawing figures, wherein like reference numerals represent like parts throughout the several views, FIG. 1 shows a shoe 10 with a lace fastening cleat 11 in a preferred form of the invention. Referring now more specifically to FIGS. 2 and 3, it will be seen that the lace fastening cleat 11 includes a generally disk shaped upper flange member 12 which is made of a tough, resilient, flexible material, such as rubber or flexible plastic. The upper flange 12 has a beveled or chamfered outer edge 13 for easing the wrapping of a lace about the lace fastening cleat 11. A central passageway 14 is formed through the upper flange 12 for receiving a rivet 16 or other suitable fastener.

A hollow cylindrical spacer or shank 17 is positioned beneath the passageway 14 and receives therethrough a portion of the rivet 16. A lower flange 18 is positioned beneath the spacer 17. Lower flange 18 is formed in the shape of a portion of a circular disk, with two chords on opposite sides removed. Thus, the lower flange 18 is generally elongated and oval. This allows the lower flange 18 to be rather narrow in the direction of direction arrow 19 which allows the lower flange to fit easily between the vamps 21 and 22 of the shoe and over the tongue 23, as shown in FIG. 1. The lower flange 18 has a beveled outer edge **24*a* and a similar beveled outer edge 24*b* opposite thereof, somewhat similar to the beveled edge 13 of the upper flange 12. However, the beveled edge of the upper flange is approximately 45°, while the beveled edges of the lower flange are more gradual, roughly 30°. The lower flange 18 also includes a central opening 25 extending therethrough for receiving the rivet 16**.

A recess 26 is formed in an upper face 27 of lower flange 18 at an outer portion thereof. The recess 26 is adapted to receive a shank portion 28 of a brass lace retaining member or button 29, the lace retaining member having lower portion **29*a* and a generally rounded upper surface 31. A second lace retaining member can be mounted to the lower flange 18, opposite lace retaining member 29**, in a similar manner.

The lower flange 18 is made of a tough, flexible, resilient material, such as rubber or flexible plastic. The spacer 17 is sized in conjunction with the height of the lace retaining member 29 to provide engagement of the upper portion 31 of the lace retaining member with an underside of the upper flange 12. In the alternative, the spacer 17 and the lace retaining member 29 can be sized to provide a slight gap between the underside of the upper flange 12 and the upper surface of the lace retaining member, as shown in FIG. 3. The gap should not be so large as to permit the lace of the shoe to pass therebetween without any force being required.

Figure 5A:
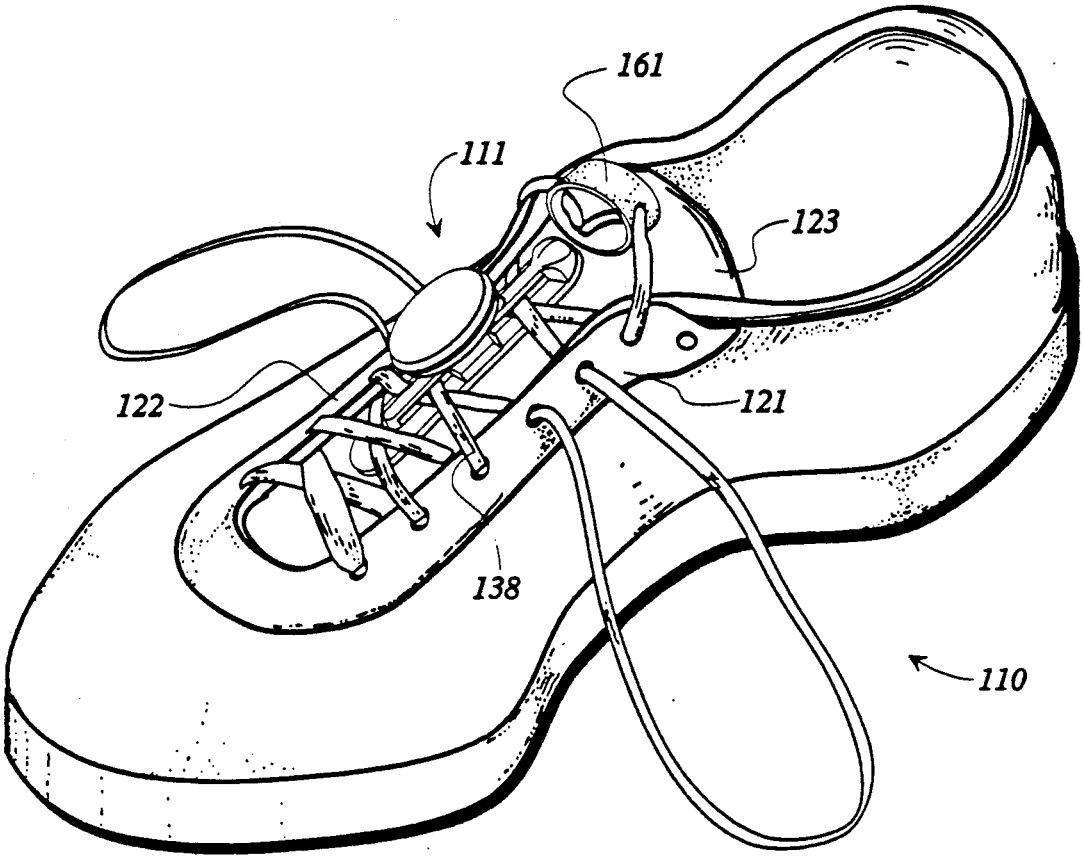
FIG. 5A is a perspective, schematic illustration of a shoe including a lace fastening cleat according to a second preferred form of the invention.

The upper flange 12, lower flange 18, and the loops formed of material 32 are secured to the tongue 23 by rivet 16. Alternatively, the fastening cleat can be simply held in place by the lace, as shown in FIG. 5A.

An elongate strip of thin, flexible material 32 is doubled over to form loops indicated at 33 and 34. An opening 36 is formed in the middle of the thin strip 32 and other openings are formed at the ends of the strip to allow the passage of the rivet 16 therethrough.

As shown in FIGS. 2 and 3, the upper and lower flanges 12 and 18 and the strip 32 are positioned above the tongue 23. A flexible, thin washer 37 is positioned in the underside of the tongue 23 for preventing a lower portion **16*a*** of the rivet from pulling through the tongue.

A lace 38 is laced through the lace eyelets of the vamps, such as lace eyelets 39 and 41. Preferably, the lace is strung through the eyelets in a conventional manner for about half of the length of the tongue, and then in a medial portion of the tongue, the lace is looped about consecutive eyelets, such as eyelets 42 and 43 to create a loop 44 of lace. The remainder of the eyelets are laced in the conventional criss-cross pattern and the ends 46 and 47 are fastened to one another by pressing them into a flexible lace end securing member 48 to create one continuous or endless lace. The lace end securing member 48 preferably is a length of sturdy, flexible tubing which is sized to snugly receive the lace ends therein and has an outside diameter which is greater than the size of the eyelets. However, anything that would couple the ends is sufficient.

Referring now to the second preferred embodiment shown in FIG. 5A, a shoe 110 includes a lace fastening cleat 111 positioned and secured over a tongue 113 of the shoe between opposite vamps 114 and 116. Notably, in comparison with the embodiment shown in FIG. 1 in which the lace fastening cleat is secured to the tongue, in this embodiment the lace fastening cleat is simply held in place by the lace 117 being threaded through the eyelets of the shoe and also through an opening, or, in the embodiment shown, two openings, of the lace fastening cleat 111.

Figure 6:
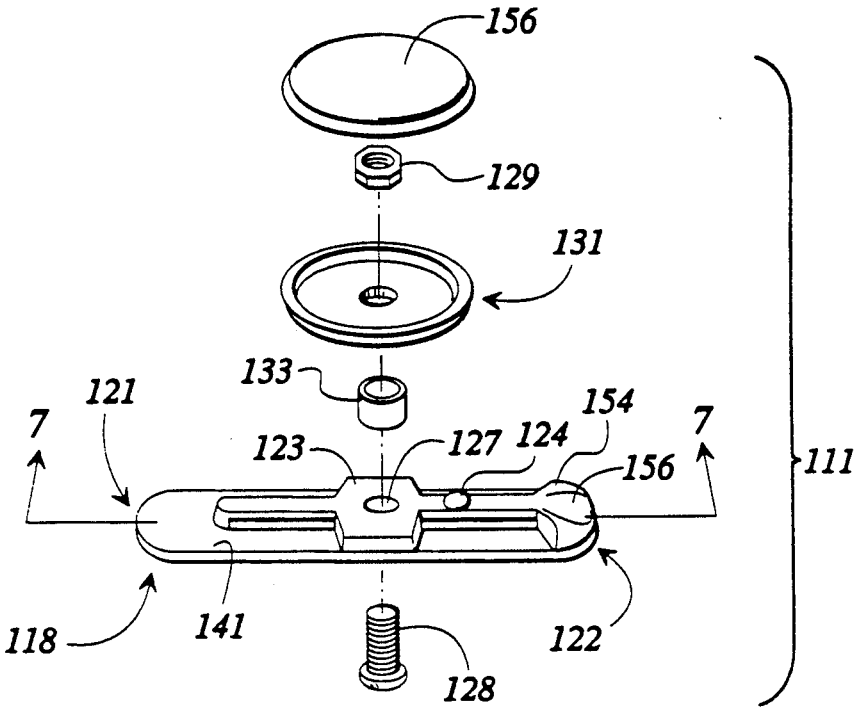
FIG. 6 is an exploded, schematic, perspective view of the lace fastening cleat portion of FIG. 5A.
Figure 7:
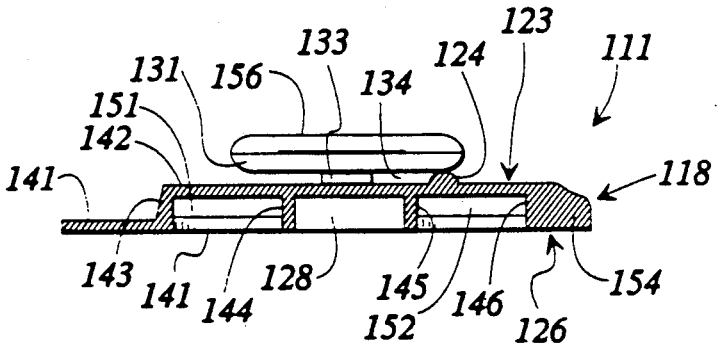
FIG. 7 is a sectional view of the lace fastening cleat shown in FIG. 6, taken along the lines 7—7.

Referring now to FIGS. 6 and 7, the details of the lace fastening cleat 111 can be examined more closely. The lace fastening cleat 111 includes a lower portion 118 which is generally elongate to be fitted between the vamps of the shoe. The lower portion 118 can be made of a tough, flexible plastic or other suitable material. The lower portion 118 has a forward end 121 and a rearward end 122 opposite the forward end. A flat upper surface 123 extends generally from the rearward end 122 toward the forward end 121. The surface 123 is interrupted by an integrally formed knob 124 in the shape of a half sphere extending upwardly from the surface 123. The underside surface 126 is generally flat to rest against or over the tongue of the shoe.

In a medial portion of the lower portion 118 of the cleat, a passageway 127 is formed therethrough for receiving a fastener 128, shown in FIGS. 6 and 7 to be a screw associated with an appropriate nut 129. Alternatively, other means of fastening can be employed, such as rivets, clips, etc. The purpose of the fastener 128, 129 is to secure an upper portion 131 of the lace fastening cleat 111 to the lower portion 118 of the cleat. Preferably, a small sleeve 133 is provided to avoid damage to the lace elements from the threads of the screw 128. The sleeve also functions to space the upper portion 131 a select distance away from the lower portion 118. The upper portion 131 is in the form of a washer-like element to define an opening between the upper and lower portions of the lace fastening cleat so that lace loops can be wrapped about the sleeve. In this manner, the upper portion 131 and the lower portion 118 define a generally short, squat cylindrical space 134 therebetween for receiving the lace elements. The half spherical knob 124 acts as a sort of latch to secure the lace in the space 134 after the lace has been wrapped about the sleeve 133. In this regard, the upper portion 131 is somewhat flexible in relation to its position overlying the lower portion 118 so as to allow ingress and egress of the lace elements into and out of the space 134.

The lower portion 118 of the lace fastening cleat 111 includes a generally planar base portion 141 integrally formed with an upper platform 142 which defines the planar surface 123. The base 141 is connected with and integrally formed with the upper platform 142 by means of upstanding portions 143, 144, 145, and 146. Together, these elements define a pair of lateral openings 151 and 152 for receiving therethrough lace elements for securing the lace fastening cleat 111 over the tongue.

The upper platform 142 is generally cross-shaped and terminates in a knob-like portion 154 which includes a recess 156. Optionally, upper portion 131 of the lace fastening cleat 111 can be provided with a cover 158. Further, while the upper and lower portions are shown as two separate elements, it is possible to form this all as one item.

Figure 5B:
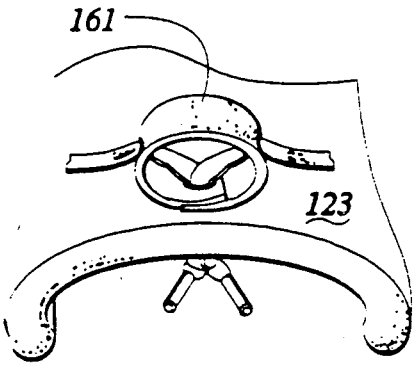
FIG. 5B is a perspective view of a portion of the shoe of FIG. 5A.
Figure 5C:
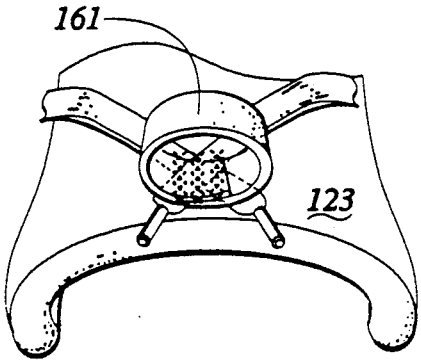
FIG. 5C is a perspective view of a portion of the shoe of FIG. 5A in a modified form.

As shown in FIGS. 5A and 5B, the ends of the lace extend through a finger loop or finger pull 161 and are secured to each other on the underside of the tongue 123. They may be secured to each other by simple tying (which allows the laces to be easily replaced or the fastening cleat to be retrofitted on conventional shoes) or may be secured to each other and to the tongue as by sewing the ends of the laces to the tongue as depicted in FIG. 5C. FIG. 5C shows that the ends of the lace can be placed on top of the tongue (shown here in a criss-cross pattern) and the loop or finger pull 161 positioned thereover and together sewn to the top of the tongue 113 to secure both the finger pull or loop 161 to the tongue and to fasten the laces.

While the flanges, the spacer and the strip forming loops are shown as separate elements (FIG. 1), these parts can be molded as a one-piece integral unit as desired. Also, rather than having one of the flanges being flexible relative to the other, generally rigid flanges can be employed by, for example, providing a movable retaining member. Also, the rivet 16 can be recessed into the upper flange to present a flat, smooth upper surface suitable for carrying a logo or other decoration.

OPERATION

In use, to secure the lace, and thusly the shoe, one pulls the loop 44*a* outwardly and pulls a corresponding loop 44*b* on the other vamp to draw the continuous lace relatively snug. This lengthens the loops 44*a* and 44*b* and prepares them for securing to the fastening cleat 11. Also, since the lace end securing member is larger in diameter than the eyelets, pulling the loops 44*a* and 44*b* ensures that the loops will be of the same length. Also, this tightens the laces rather evenly, since the upper and lowermost laces are generally equidistant from loops 44*a* and 44*b*, from where the tightening forces originate. This allows rapid, uniform tightening of the laces.

Figure 4:
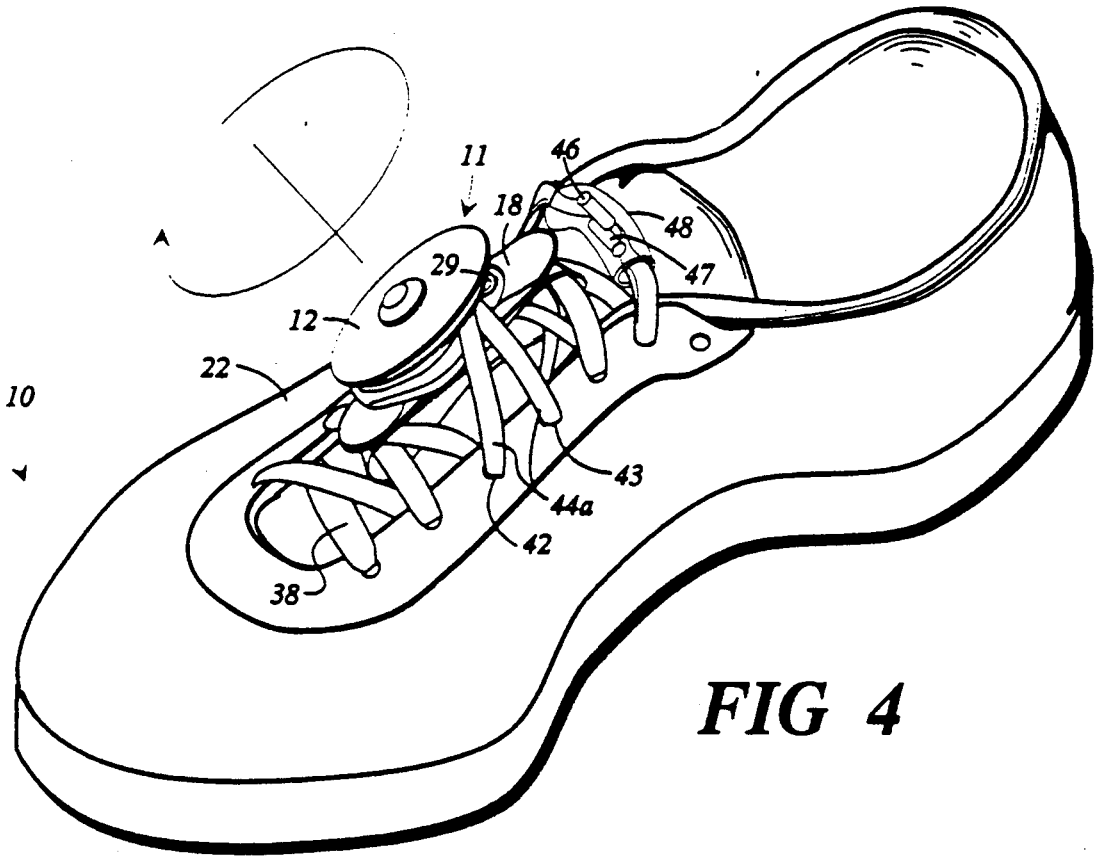
FIG. 4 is a schematic, perspective illustration of the shoe of FIG. 1, depicting how the lace of the shoe is fastened.

The two loops extending from four middle eyelets are then wrapped about the lace fastening cleat 11, as depicted in FIG. 4. As the lace is pulled tightly about the lace fastening cleat, the lace forces its way between the upper surface 31 of the lace retaining member 29 and the undersurface of the upper flange 12. Once positioned within the lace retaining space indicated at 49 in FIG. 3, the lace is prevented from accidentally becoming unraveled, but rather only can be removed from within the space by pulling the lace. This is so because the space (or lack thereof) between the underside surface of the upper flange 12 and the upper surface 31 of the lace retaining member 29 prevents the lace from accidentally passing therebetween. Rather, force is required so that the resiliency of the upper flange is overcome, thereby forcing the upper flange to spread apart somewhat from the lower flange to increase the gap between the upper flange and the upper surface of the retaining member. This slight spreading of the upper and lower flanges, both during winding of the lace about the shank 17 and during unwinding of the lace, effectively releasably secures the lace in the lace retaining region.

Operation and use of the shoe with lace fastening cleat depicted in FIGS. 5A–7 is substantially the same as described above with regard to the first embodiment. The second embodiment likewise has similar advantages with respect to the ease of fastening the shoe laces, particularly so for children or for adults who have physical impairments, such as having only one working digit or prosthetic. Furthermore, the finger pull 161 allows the tongue to be pulled upwardly when the laces are loose (as depicted in FIG. 5A) to allow the shoe to be easily slipped on and off. Once the shoe is on the foot of the wearer, one would then pull each of the lace loops taut, either at the same time or one after the other, and then wrap the individual lace loops about the lace fastening cleat 111 one after the other. The recess 156 in the portion 154 provides easy access for the finger or prosthetic of the user into the finger pull 161 without obstruction.

It will be appreciated from the above that, according to the inventions disclosed herein, no knot needs to be tied in the lace to secure the shoe. Rather, one can simply pull the loops with one finger outwardly from the vamps and then, also using only one finger or one hand, can wrap the lace about the lace fastening cleat. This arrangement is quite useful for those persons having limited manual dexterity or limited manual strength. Also, this is highly useful for people having the use of only one hand or one finger, or for small children. The construction shown in the figures and described above also is relatively low in profile and is therefore unobtrusive. Also, the resilient, flexible flanges allow some flexing of the lace fastening cleat to accommodate flexing of the shoe in use by the wearer.

While the invention has been disclosed in a preferred form, it will be obvious to those skilled in the art that many modifications, additions, and deletions can be made therein without departing from the spirit and scope of the invention as set forth in the following claims.

I claim:

1. A fastening cleat for securing laces of a shoe, said fastening cleat comprising:

a first portion adapted to be secured over the shoe;

a second portion mounted over said first portion for defining a lace receiving opening between said first and second portions;

a lace retaining member positioned on one of said first and second portions and extending toward the other of said first and second portions; and said second portion being flexible relative to said first portion to allow said first and second portions to move apart from one another adjacent said lace retaining member in response to the laces being pulled for winding and unwinding the laces about said fastening cleat;

wherein said first portion is generally elongate and is adapted to be positioned substantially between the vamps of the shoe and wherein said first portion comprises at least one opening transverse to the elongation for receiving a lace therethrough for securing said fastening cleat over the tongue of the shoe.

2. A fastening cleat as claimed in claim 1 wherein said lace retaining member has a generally rounded upper portion.

3. A shoe comprising:

a tongue;

a lace;

two vamps having lace eyelets for receiving said lace and straddling and partially overlying said tongue; and a fastening cleat positioned over said tongue generally between said vamps, said fastening cleat comprising an elongated lower portion positioned over the tongue between said vamps, a second portion mounted over said lower portion to define a lace receiving opening between said lower and upper portions, a lace retaining member positioned on one of said lower and upper portions and extending toward the other of said lower and upper portions, and said upper portion being flexible relative to said lower portion to allow said upper and lower portions to move apart from one another adjacent said lace retaining member in response to said lace being pulled for winding an unwinding said lace about said cleat in said lace receiving opening thereof.

4. A shoe as claimed in claim 3 wherein said lower and upper portions are chamfered to facilitate introduction of said lace into said lace receiving opening.

5. A shoe as claimed in claim 3 wherein said lace retaining member has a generally rounded end portion.

6. A shoe as claimed in claim 3 further comprising a flexible loop means secured to said lower portion and extending over the tongue for receiving a section of said lace therethrough.

7. A shoe as claimed in claim 3 further comprising a finger pull secured to said tongue for lifting said tongue.

8. A shoe as claimed in claim 3 wherein said lace has first and second ends secured to each other to form an endless lace.

9. A shoe as claimed in claim 3 wherein said lace fastening cleat is secured to a medial portion of said tongue.

10. A shoe as claimed in claim 3 wherein said lace fastening cleat is elongate and includes at least one opening therein transverse to the elongation for receiving said lace therethrough for securing said lace fastening cleat over said tongue.

11. A shoe as claimed in claim 3 wherein said lace has first and second ends secured to said tongue to form an endless lace.

* * * * *